US008158718B2

(12) United States Patent
Shimada et al.

(10) Patent No.: US 8,158,718 B2
(45) **Date of Patent: *Apr. 17, 2012**

(54) POLYETHYLENE NAPHTHALATE FIBERS AND METHOD FOR PRODUCING THE SAME

(75) Inventors: Shintaro Shimada, Matsuyama (JP); Fuyuki Terasaka, Matsuyama (JP)

(73) Assignee: Teijin Fibers Limited, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/922,345

(22) PCT Filed: Mar. 4, 2009

(86) PCT No.: PCT/JP2009/054590

§ 371 (c)(1),
(2), (4) Date: Sep. 13, 2010

(87) PCT Pub. No.: WO2009/113554

PCT Pub. Date: Sep. 17, 2009

(65) Prior Publication Data

US 2011/0015326 A1 Jan. 20, 2011

(30) Foreign Application Priority Data

Mar. 14, 2008 (WO) ..... PCT/JP2008/055170

(51) Int. Cl.
*C08L 67/03* (2006.01)

(52) U.S. Cl. ..... 524/604; 524/130; 524/133; 524/439; 524/440; 528/276; 528/280; 528/281; 264/210.8

(58) Field of Classification Search ..... 524/130, 524/133, 439, 440, 604; 528/276, 280, 281; 264/210.8

See application file for complete search history.

(56) References Cited

U.S. PATENT DOCUMENTS

| | | | | |
|---|---|---|---|---|
| 6,511,747 | B1 | 1/2003 | Cho et al. | |
| 6,593,447 | B1 | 7/2003 | Yamamoto | |
| 2007/0116951 | A1 | 5/2007 | Kwon et al. | |
| 2011/0040009 | A1* | 2/2011 | Shimida et al. | 524/407 |

FOREIGN PATENT DOCUMENTS

| | | | |
|---|---|---|---|
| EP | 0 169 415 | A2 | 1/1986 |
| JP | 62-156312 | A | 7/1987 |
| JP | 04-352811 | A | 12/1992 |
| JP | 06-184815 | A | 7/1994 |
| JP | 2002-293909 | A | 10/2002 |
| JP | 2002-339161 | A | 11/2002 |
| WO | 01/00706 | A1 | 1/2001 |

* cited by examiner

*Primary Examiner* — Peter Szekely
(74) *Attorney, Agent, or Firm* — Sughrue Mion, PLLC

(57) ABSTRACT

Polyethylene naphthalate fibers that are characterized in that the fibers have a crystal volume of from 100 to 200 $nm^3$ obtained by wide angle X-ray diffraction of the fiber and a degree of crystallization of from 30 to 60%. It is preferred that the fibers have a maximum peak diffraction angle of wide angle X-ray diffraction of from 23.0 to 25.0°. The production method thereof is characterized in that a particular phosphorus compound is added to the polymer in a molten state, the spinning speed is from 4,000 to 8,000 m/min, and the molten polymer immediately after discharging from the spinneret is allowed to pass through a heated spinning chimney at a high temperature exceeding a temperature of the molten polymer by 50° C. or more, and is drawn.

15 Claims, 3 Drawing Sheets

POLYETHYLENE NAPHTHALATE FIBERS AND METHOD FOR PRODUCING THE SAME

TECHNICAL FIELD

The present invention relates to polyethylene naphthalate fibers that are excellent in fatigue property and are useful as industrial materials and the like, particularly a tire cord, rubber reinforcing fibers for a driving belt and the like, and to a method for producing the same.

BACKGROUND ART

Polyethylene naphthalate fibers exhibit high tenacity, high modulus and excellent dimensional stability, and is now being applied widely to the field of industrial materials including a tire cord and a rubber reinforcing material for a driving belt and the like. In particular, they are superior to polyethylene terephthalate fibers having been conventionally used since they attain both high strength and dimensional stability, and are strongly expected as a substitute thereof. Polyethylene naphthalate fibers contain molecules that are rigid and liable to align in the fiber axis, and therefore are superior to the conventional polyethylene terephthalate fibers since they attain both high strength and dimensional stability.

For maximizing the characteristics thereof, Patent Document 1, for example, discloses polyethylene naphthalate fibers that are excellent in strength and hot air shrinkage by high-speed spinning polyethylene naphthalate fibers. However, there is a problem that the fibers exhibit high hot air shrinkage when they have high strength, and the strength thereof is decreased when the hot air shrinkage is suppressed, thereby failing to attain a satisfactory level.

Patent Document 2 discloses polyethylene naphthalate fibers that have a tenacity of 7.0 g/de (ca. 6 cN/dtex) or more while maintaining the hot air shrinkage to the same level, by providing a spinning chimney heated to 390° C. immediately beneath the melt-spinning die(spinneret) to perform high-speed spinning and hot drawing. However, the fibers that are obtained in the best example still have an insufficient tenacity of 8.0 g/de (ca. 6.8 cN/dtex), and thus are not satisfactory as fibers having high strength while maintaining heat resistance and dimensional stability.

As different from Patent Document 2, Patent Document 3 proposes polyethylene naphthalate fibers that have high strength and relatively good heat stability formed in such a manner that an undrawn yarn formed with a drawing speed of 1,000 m/min or less and a low draft of about 60 times is subjected to delayed cooling with a spinning chimney having a length of from 20 to 50 cm and an atmospheric temperature of from 275 to 350° C., and then to stretching at a high draw ratio. Patent Document 4 proposes polyethylene naphthalate fibers that have high strength and excellent dimensional stability formed in such a manner that an undrawn yarn having a low birefringence of from 0.005 to 0.025 is obtained at a spinning draft ratio of from 400 to 900, and is then subjected to multi-stage draw at a total draw ratio of 6.5 or more.

These methods provide improvement of a single property among strength, hot air shrinkage and the like of fibers. However, polyethylene naphthalate fibers obtained by any one of these methods still involve such a problem that they are rigid as compared to conventional polyethylene terephthalate fibers and are inferior in fatigue resistance in a composite material. In particular, they have a problem that the fibers are inferior in durability when they are formed into a composite material, in which the fibers receive repeated load, such as those for reinforcing rubber.

(Patent Document 1) JP-A-62-156312
(Patent Document 2) JP-A-06-184815
(Patent Document 3) JP-A-04-352811
(Patent Document 4) JP-A-2002-339161

DISCLOSURE OF THE INVENTION

Problems to be Solved by the Invention

In view of the aforementioned current situations, an object of the invention is to provide polyethylene naphthalate fibers that are excellent in fatigue resistance while having high strength, and are useful as industrial materials and the like, particularly a tire cord and rubber reinforcing fibers for a driving belt or the like, and a method for producing the same.

Means for Solving the Problems

The polyethylene naphthalate fibers of the invention contain ethylene naphthalate as a major repeating unit, characterized in that the fibers have a crystal volume of from 100 to 200 $nm^3$ obtained by wide angle X-ray diffraction of the fiber and a degree of crystallization of from 30 to 60%.

It is preferred that the fibers have a maximum peak diffraction angle of wide angle X-ray diffraction of from 23.0 to 25.0°, and contain phosphorus atoms in an amount of from 0.1 to 300 mmol % based on the ethylene naphthalate unit. It is also preferred that the polyethylene naphthalate fibers contain a metallic element, and the metallic element is at least one metallic element selected from the group of metallic elements of the groups 3 to 12 in the fourth and fifth periods in the periodic table and Mg, and it is more preferred that the metallic element is at least one metallic element selected from the group of Zn, Mn, Co and Mg.

It is preferred that the fibers have an exothermic peak energy ΔHcd of from 15 to 50 J/g under a nitrogen stream and a temperature decreasing condition of 10° C. per minute, a tenacity of from 6.0 to 11.0 cN/dtex, and a melting point of from 265 to 285° C.

The method for producing polyethylene naphthalate fibers of another aspect of the invention contains melting a polymer having ethylene naphthalate as a major repeating unit, and discharging the polymer from a spinneret(spinning die), characterized in that at least one of a phosphorus compound represented by the following formula (I) or (II) is added to the polymer in a molten state, which is then discharged from the spinneret, with a spinning speed of from 4,000 to 8,000 m/min, and the molten polymer immediately after discharging from the spinneret is allowed to pass through a heated spinning chimney at a high temperature exceeding a temperature of the molten polymer by 50° C. or more, and is drawn:

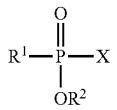

(I)

wherein $R^1$ represents an alkyl group, an aryl group or a benzyl group as a hydrocarbon group having from 1 to 20 carbon atoms; $R^2$ represents a hydrogen atom, or an alkyl group, an aryl group or a benzyl group as a hydrocarbon group having from 1 to 20 carbon atoms; and X represents a hydrogen atom or a —$OR^3$ group, wherein when X represents a —$OR^3$ group, $R^3$ represents a hydrogen atom, or an alkyl group, an aryl group or a benzyl group as a hydrocarbon group having from 1 to 12 carbon atoms, provided that $R^2$ and $R^3$ may be the same as or different from each other,

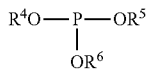

(II)

wherein $R^4$ to $R^6$ each represent an alkyl group, an aryl group or a benzyl group as a hydrocarbon group having from 4 to 18 carbon atoms, provided that $R^4$ to $R^6$ may be the same as or different from each other.

It is preferred that the spinning draft ratio after discharging from the spinneret is from 100 to 10,000, and the heated spinning chimney has a length of from 250 to 500 mm.

The phosphorus compound is preferably a compound represented by the following general formula (I'), and the phosphorus compound is particularly preferably phenylphosphinic acid or phenylphosphonic acid:

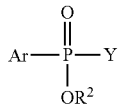

(I')

wherein Ar represents an aryl group as a hydrocarbon group having from 6 to 20 carbon atoms; $R^2$ represents a hydrogen atom, or an alkyl group, an aryl group or a benzyl group as a hydrocarbon group having from 1 to 20 carbon atoms; and Y represents a hydrogen atom or a —OH group.

Advantages of the Invention

According to the invention, polyethylene naphthalate fibers are provided that are excellent in fatigue resistance while having high strength, and are useful as industrial materials and the like, particularly a tire cord and rubber reinforcing fibers for a driving belt or the like, and a method for producing the same is provided.

EXPLANATION OF SYMBOLS

Figure 1:
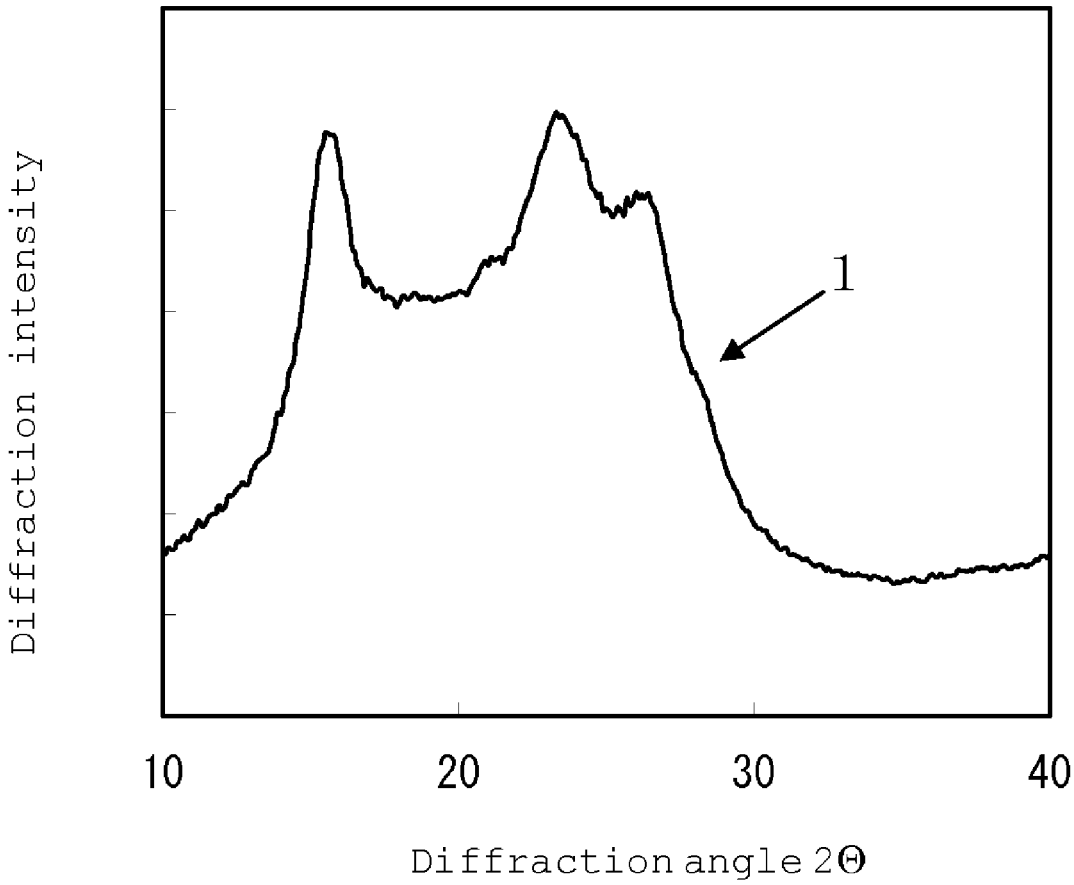
FIG. 1 is a wide angle X-ray diffraction spectrum of Example 4, which is a product according to the invention.
Figure 2:
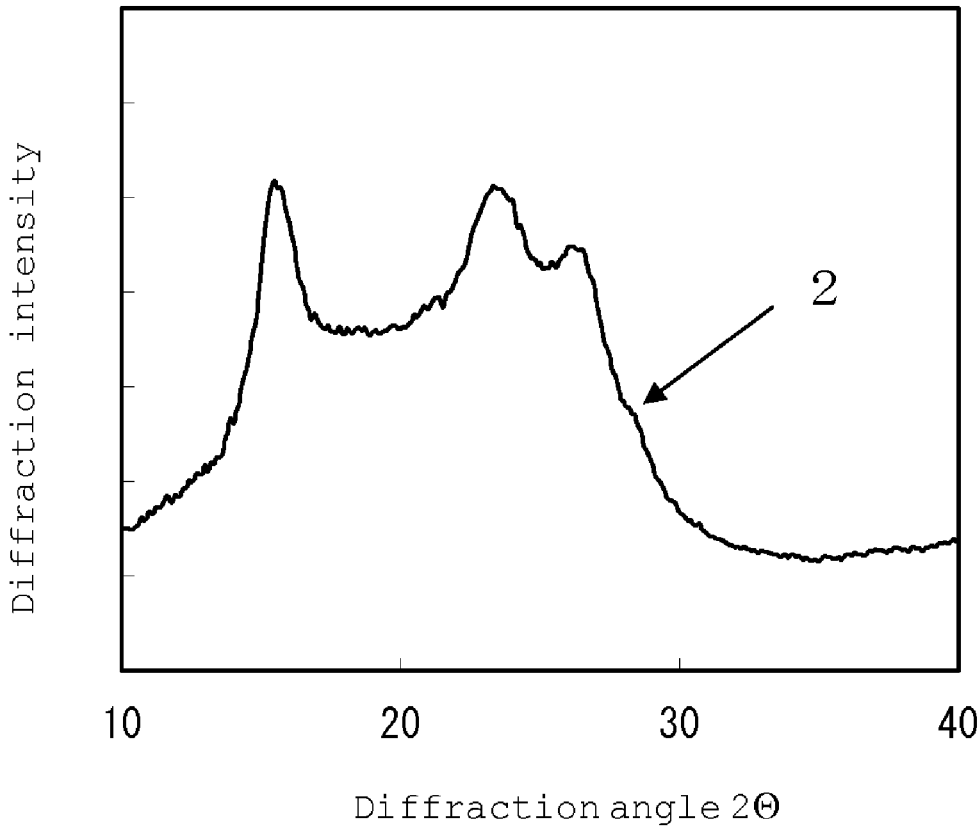
FIG. 2 is a wide angle X-ray diffraction spectrum of Comparative Example 1, which is a conventional product.
Figure 3:
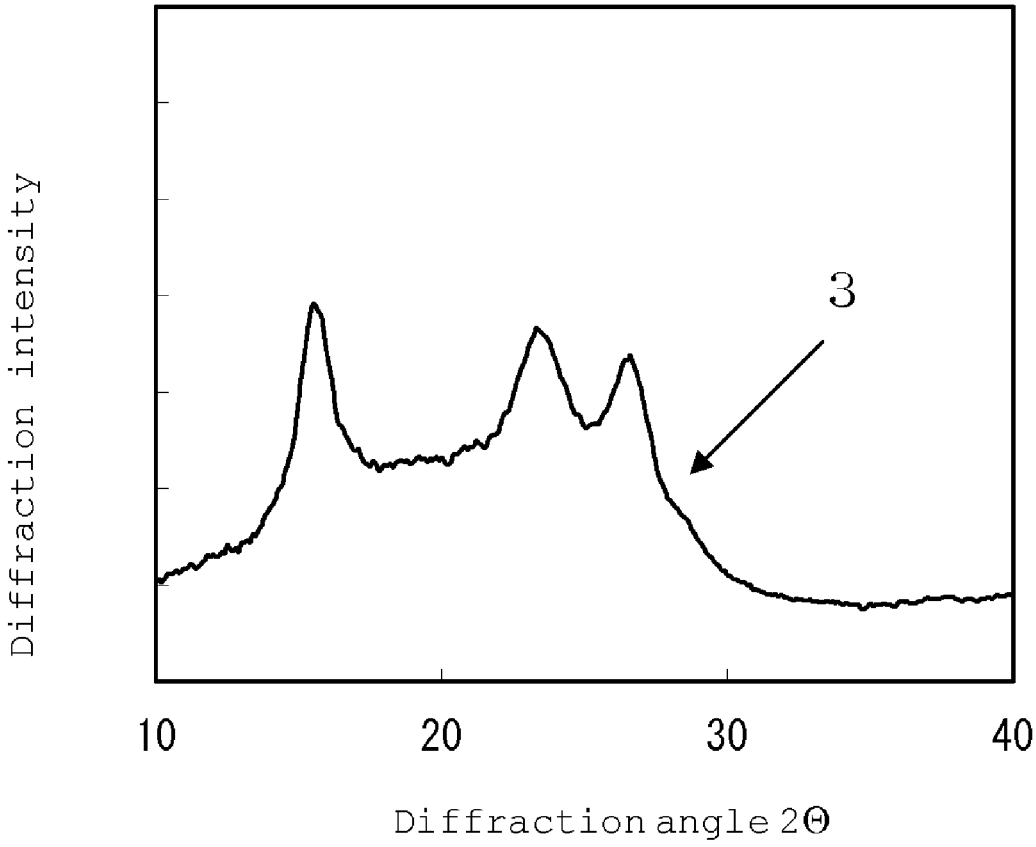
FIG. 3 is a wide angle X-ray diffraction spectrum of Comparative Example 3.

1 Example 4
2 Comparative Example 1
3 Comparative Example 3

BEST MODE FOR CARRYING OUT THE INVENTION

The polyethylene naphthalate fibers of the invention contain ethylene naphthalate as a major repeating unit. The polyethylene naphthalate fibers preferably contain an ethylene-2,6-naphthalate unit in an amount of 80% or more, and particularly 90% or more. The polyethylene naphthalate fibers may be a copolymer containing a suitable third component in a small amount. Polyethylene terephthalate, which is also a polyester, has no clear crystalline structure and cannot be the fibers of the invention having both high tenacity and high elastic modulus.

The polyethylene naphthalate fibers can generally be formed by melt-spinning a polyethylene naphthalate polymer. The polyethylene naphthalate polymer can be formed by polymerizing naphthalene-2,6-dicarboxylic acid or a functional derivative thereof in the presence of a catalyst under suitable reaction condition. A polyethylene naphthalate copolymer can be synthesized by adding one kind or two or more kinds of a suitable third component before completing polymerization of polyethylene naphthalate.

Suitable examples of the third component include (a) a compound having two ester-forming functional groups, for example, an aliphatic dicarboxylic acid, such as oxalic acid, succinic acid, adipic acid, sebacic acid, dimer acid and the like; an alicyclic dicarboxylic acid, such as cyclopropanedicarboxylic acid, cyclobutanedicarboxylic acid, hexahydroterephthalic acid and the like; an aromatic dicarboxylic acid, such as phthalic acid, isophthalic acid, naphthalene-2,7-dicarboxylic acid, diphenyldicarboxylic acid and the like; a carboxylic acid, such as diphenyletherdicarboxylic acid, diphenylsulfonedicarboxylic acid, diphenoxyethanedicarboxylic acid, sodium 3,5-dicarboxybenzenesulfonate and the like; an oxycarboxylic acid, such as glycolic acid, p-oxybenzoic acid, p-oxyethoxybenzoic acid and the like; an oxy compound, such as propylene glycol, trimethylene glycol, diethylene glycol, tetramethylene glycol, hexamethylene glycol, neopentylene glycol, p-xylylene glycol, 1,4-cyclohexanedimethanol, bisphenol A, p,p'-diphenoxysulfone-1,4-bis(β-hydroxyethoxy)benzene, 2,2-bis(p-β-hydroxyethoxyphenyl)propane, polyalkylene glycol, p-phenylenebis(dimethylcyclohexane) and the like, or a functional derivative thereof; a highly polymerized compound derived from the carboxylic acids, the oxycarboxylic acids, and the oxy compounds or the functional derivative thereof, and (b) a compound having one ester-forming functional group, for example, benzoic acid, benzoylbenzoic acid, benzyloxybenzoic acid, methoxypolyalkylene glycol and the like. Furthermore, (c) a compound having three or more ester-forming functional groups, for example, glycerin, pentaerythritol, trimethylolpropane, tricarballylic acid, trimesic acid, trimellitic acid and the like, may be used in such a range that the polymer is substantially in a linear form.

The polyethylene naphthalate may contain various kinds of additives, for example, an additive, such as a matte agent, e.g., titanium dioxide and the like, a heat stabilizer, a defoaming agent, an orthochromatic agent, a flame retardant, an antioxidant, an ultraviolet ray absorbent, an infrared ray absorbent, a fluorescent whitening agent, a plasticizer and an impact resisting agent, and a reinforcing agent, such as montmorillonite, bentonite, hectorite, plate iron oxide, plate calcium carbonate, plate boehmite, carbon nanotubes and the like.

The polyethylene naphthalate fibers of the invention are fibers containing the polyethylene naphthalate, and necessarily have a crystal volume of from 100 to 200 $nm^3$ (from 100,000 to 200,000 $Å^3$) obtained by wide angle X-ray diffraction and a degree of crystallization of from 30 to 60%. The degree of crystallization is preferably from 35 to 55%. The crystal volume in this application is a product of crystalline sizes obtained from diffraction peaks at diffraction angles of from 15 to 16°, from 23 to 25°, and from 22.5 to 27°, in wide angle X-ray diffraction in the equatorial direction of the fibers. The diffraction angles are each ascribed to the crystal planes (010), (100) and (1-10) of the polyethylene naphthalate fibers, respectively, and theoretically correspond to the Bragg angles 2θ, but the peaks slightly shift depending on fluctuation of the total crystal structure. The crystal structure is inherent to polyethylene naphthalate fibers and is not found in polyethylene terephthalate fibers, which are also polyester fibers.

The degree of crystallization (Xc) in this application is a value obtained from the specific gravity (ρ) and the perfect amorphous density (ρa) and the perfect crystal density (ρc) of the polyethylene naphthalate according to the following expression (1).

$$\text{degree of crystallization } Xc=\{\rho c(\rho-\rho a)/\rho(\rho c-\rho a)\}\times 100 \quad (1)$$

wherein

ρ: specific gravity of polyethylene naphthalate fibers

ρa: 1.325 (perfect amorphous density of polyethylene naphthalate fibers)

ρc: 1.407 (perfect crystal density of polyethylene naphthalate fibers)

The polyethylene naphthalate fibers of the invention achieve a small crystal volume of 200 $nm^3$ (200,000 $Å^3$) (or less), which has not yet achieved by conventional products, while maintaining a high degree of crystallization that is equivalent to conventional high strength fibers. The fibers of the invention provide thereby high strength and dimensional stability. A homogeneous structure is formed with fine crystals, whereby fine defects in the polymer of the polyethylene naphthalate fibers of the invention are considerably decreased to exhibit excellent fatigue resistance. It is effective that the degree of crystallinity is as high as possible, and a degree of crystallinity of less than 30% cannot attain high tensile strength and modulus. In general, the crystal volume is increased for increasing the degree of crystallinity, but the invention has such a characteristic feature that a high degree of crystallinity is obtained even though the crystal volume is small.

A small crystal volume can be effectively obtained by a method of spinning at a high speed while maintaining the temperature under spinneret high upon spinning. In general, there is a tendency that the crystal volume is increased when the fibers are stretched with an increased spinning draft ratio or an increased draw ratio, and crystals can be prevented from growing by spinning at a high speed while maintaining the temperature under spinneret high upon spinning.

An increased degree of crystallization can be obtained by stretching the fibers by increasing the spinning draft ratio, the draw ratio and the like. However, when the degree of crystallization is increased, the polyethylene naphthalate fibers, which are rigid fibers, are increasingly liable to be broken. It is therefore important in the invention that a fine and homogeneous crystal structure is formed in the stage of a polymer before spinning, for preventing breakage of yarn and decreasing the crystal volume of the fiber to be obtained. The breakage of yarn due to stress concentration can be prevented to enhance the fatigue resistance owing to the absence of large crystals and the presence of the fine and homogeneous crystal structure. For example, the addition of a particular phosphorus compound to the polymer realizes the fine and homogeneous crystal structure.

The polyethylene naphthalate fibers of the invention preferably have a maximum peak diffraction angle of wide angle X-ray diffraction in a range of from 23.0 to 25.0°. The (100) plane among the crystal planes (010), (100) and (1-10) grows largely, whereby the homogeneity of the crystals is enhanced, thereby achieving both dimensional stability and high strength simultaneously at a high level.

The polyethylene naphthalate fibers of the invention preferably have an exothermic peak energy ΔHcd of from 15 to 50 J/g under temperature decreasing condition. It is more preferably from 20 to 50 J/g, and particularly preferably 30 J/g or more. The exothermic peak energy ΔHcd under temperature decreasing condition referred herein is measured in such a manner that the polyethylene naphthalate fibers are heated under a nitrogen stream to 320° C. at a temperature increasing condition of 20° C. per minute and maintained in a molten state for 5 minutes, and then the exothermic peak energy is measured with a differential scanning calorimeter (DSC) under a temperature decreasing condition of 10° C. per minute. It is considered that the exothermic peak energy ΔHcd under temperature decreasing condition shows crystallization upon decreasing temperature under temperature decreasing condition.

The polyethylene naphthalate fibers of the invention preferably have an exothermic peak energy ΔHc of from 15 to 50 J/g under temperature increasing condition. It is more preferably from 20 to 50 J/g, and particularly preferably 30 J/g or more. The exothermic peak energy ΔHc under temperature increasing condition referred herein is measured in such a manner that the polyethylene naphthalate fibers are maintained in a molten state at 320° C. for 2 minutes, and then solidified in liquid nitrogen to form a quenched solid polyethylene naphthalate, which is then measured for exothermic peak energy with a differential scanning calorimeter under a nitrogen stream under a temperature increasing condition of 20° C. per minute. It is considered that the exothermic peak energy ΔHc under temperature increasing condition shows crystallization of the polymer constituting the fibers upon increasing temperature under temperature increasing condition. The influence of thermal history upon forming fibers can be reduced by once melting and solidifying by cooling.

In the case where the energy ΔHcd or ΔHc is low, it is not preferred since there is a tendency of lowering the crystallinity. In the case where the energy ΔHcd or ΔHc is too high, there is a tendency of advancing crystallization excessively upon spinning the polyethylene naphthalate fibers and thermally setting the fibers in drawing, which provides a tendency of failing to provide fibers having high strength since the crystal growth impairs the spinning and drawing operations. In the case where the energy ΔHcd or ΔHc is too high, it may induce frequent breakage of the yarn upon production.

The polyethylene naphthalate fibers of the invention preferably contain phosphorus atoms in an amount of from 0.1 to 300 mmol % based on the ethylene naphthalate unit. The content of phosphorus atoms is preferably from 10 to 200 mmol %. This is because the crystallinity can be easily controlled with a phosphorus compound.

The polyethylene naphthalate fibers of the invention generally contain a metallic element as a catalyst, and the metallic element contained in the fibers is preferably at least one metallic element selected from the group of metallic elements of the groups 3 to 12 in the fourth and fifth periods in the periodic table and Mg. In particular, the metallic element contained in the fibers is preferably at least one metallic element selected from the group of Zn, Mn, Co and Mg. While the reasons therefor are not clear, the combination use of these metallic elements and a phosphorus compound particularly facilitates provision of amorphous crystals with less fluctuation in crystal volume.

The content of the metallic element is preferably from 10 to 1.000 mmol % based on the ethylene naphthalate unit. The P/M ratio, which is a ratio of the phosphorus element P and the metallic element M, is preferably in a range of from 0.8 to 2.0. In the case where the P/M ratio is too small, the metal concentration becomes excessive to provide a tendency that the excessive metallic component facilitates thermal decomposition of the polymer, thereby impairing the heat stability. In the case where the P/M ratio is too large, on the other hand, the phosphorus compound becomes excessive to provide a tendency that the polymerization reaction of the polyethylene naphthalate polymer is impaired to deteriorate the properties of the fibers. The P/M ratio is more preferably from 0.9 to 1.8.

The polyethylene naphthalate fibers of the invention preferably have a tenacity of from 6.0 to 11.0 cN/dtex. It is more preferably from 7.0 to 10.0 cN/dtex, and further preferably from 7.5 to 9.5 cN/dtex. There is a tendency of decreasing the durability not only in the case where the tenacity is too low, but also in the case where the tenacity is too high. When the fibers are produced with a high tenacity that is just capable of performing the operation, there is a tendency that the yarn is frequently broken in the yarn making process to provide a problem in quality stability as industrial fibers.

It is also preferred that the hot air shrinkage is from 4.0 to 10.0% at 180° C. It is more preferably from 5.0 to 9.0%. In the case where the hot air shrinkage is too high, there is a tendency of increasing dimensional change upon processing, thereby deteriorating the dimensional stability of the molded article using the fibers.

The melting point is preferably from 265 to 285° C. It is optimally from 270 to 280° C. In the case where the melting point is too low, there is a tendency of deteriorating the heat resistance and the dimensional stability. Too high a melting point provides a tendency of making melt-spinning difficult.

The polyethylene naphthalate fibers of the invention preferably have an intrinsic viscosity IVf in a range of from 0.6 to 1.0. When the intrinsic viscosity is too low, it is difficult to provide the polyethylene naphthalate fibers that have high tenacity and high modulus and are excellent in dimensional stability, which are intended in the invention. In the case where the intrinsic viscosity is unnecessarily high, on the other hand, the yarn is frequently broken in the yarn making process to make industrial production difficult. The intrinsic viscosity IVf of the polyethylene naphthalate fibers of the invention is particularly preferably in a range of from 0.7 to 0.9.

The filament fineness of the polyethylene naphthalate fibers of the invention is not particularly limited and is preferably from 0.1 to 100 dtex per filament from the standpoint of yarn making property. It is particularly preferably from 1 to 20 dtex per filament from the standpoint of tenacity, heat resistance and adhesion property as a tire cord, rubber reinforcing fibers for a V-belt and the like, and fibers for industrial materials.

The total fineness thereof is also not particularly limited and is preferably from 10 to 10,000 dtex, and particularly preferably from 250 to 6,000 dtex as a tire cord, rubber reinforcing fibers for a V-belt and the like, and fibers for industrial materials. As for the total fineness, from 2 to 10 yarn bundles may be preferably combined during spinning or drawing or after spinning or drawing, for example, two yarn bundles each having 1,000 dtex may be combined to provide a total fineness of 2,000 dtex.

The polyethylene naphthalate fibers of the invention may be preferably in the form of a cord, which is formed by twisting the polyethylene naphthalate fibers as multifilament. Upon twisting the fibers as multifilament, the utilization factors of strength are averaged to improve the fatigue resistance thereof. The number of twisting is preferably in a range of from 50 to 1,000 turn/m, and a cord obtained by combining yarn bundles having been twisted as multifilament and then twisted in the opposite direction as plural filaments is also preferred. The number of the filaments constituting the yarn before combining is preferably from 50 to 3,000. The use of the multifilament enhances the fatigue resistance and the flexibility. In the case where the fineness is too small, there is a tendency of making the strength insufficient. In the case where the fineness is too large, there is a tendency of causing a problem of failing to provide flexibility due to too large thickness, and agglutination among monofilaments occurs upon spinning, thereby being difficult to produce the fibers stably.

The polyethylene naphthalate fibers of the invention having the aforementioned characteristics have a considerably smaller crystal volume than conventional polyethylene naphthalate fibers, and are difficult to suffer occurrence of defects. Accordingly, the fibers are optimum as rubber reinforcing fibers that suffer large extent of expansion and contraction in the material.

The polyethylene naphthalate fibers of the invention can be produced by the method for producing polyethylene naphthalate fibers according to another aspect of the invention. Specifically, the method for producing polyethylene naphthalate fibers contains melting a polymer having ethylene naphthalate as a major repeating unit, and discharging the polymer from a spinneret, in which at least one of a phosphorus compound represented by the following formula (I) or (II) is added to the polymer in a molten state, which is then discharged from the spinneret, with a spinning speed of from 4,000 to 8,000 m/min, and the molten polymer immediately after discharging from the spinneret is allowed to pass through a heated spinning chimney at a high temperature exceeding a temperature of the molten polymer by 50° C. or more, and is drawn:

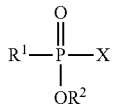

(I)

wherein $R^1$ represents an alkyl group, an aryl group or a benzyl group as a hydrocarbon group having from 1 to 20 carbon atoms; $R^2$ represents a hydrogen atom, or an alkyl group, an aryl group or a benzyl group as a hydrocarbon group having from 1 to 20 carbon atoms; and X represents a hydrogen atom or a —$OR^3$ group, wherein when X represents a —$OR^3$ group, $R^3$ represents a hydrogen atom, or an alkyl group, an aryl group or a benzyl group as a hydrocarbon group having from 1 to 12 carbon atoms, provided that $R^2$ and $R^3$ may be the same as or different from each other,

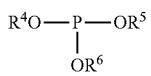

(II)

wherein $R^4$ to $R^6$ each represent an alkyl group, an aryl group or a benzyl group as a hydrocarbon group having from 4 to 18 carbon atoms, provided that $R^4$ to $R^6$ may be the same as or different from each other.

The polymer having ethylene naphthalate as a major repeating unit used in the invention is preferably polyethylene naphthalate containing an ethylene-2,6-naphthalate unit in an amount of 80% or more, and particularly 90% or more. The polymer may be a copolymer containing a suitable third component in a small amount.

Examples of the suitable third component include (a) a compound having two ester-forming functional groups and (b) a compound having one ester-forming functional group, and also include (c) a compound having three or more ester-forming functional groups and the like in such a range that the polymer is substantially in a linear form. The polyethylene naphthalate may contain various kinds of additives.

The polyester of the invention can be produced according to a production method of polyester having been known in the art. Specifically, a dialkyl ester of 2,6-naphthalenedicarboxylic acid, represented by napthalene-2,6-dimethyl carboxylate (NDC), as an acid component and ethylene glycol as a glycol component are subjected to ester exchange reaction, and then the reaction product is heated under reduced pressure to perform polycondensation while removing an excessive diol, thereby producing the polyester. In alternative, 2,6-naphthalenedicarboxylic acid as an acid component and ethylene glycol as a diol component are subjected to esterification, thereby producing the polyester by a direct polymerization method having been known in the art.

The ester exchange catalyst used in the case where the ester exchange reaction is utilized is not particularly limited, and examples thereof include compounds of manganese, magnesium, titanium, zinc, aluminum, calcium, cobalt, sodium, lithium and lead. Examples of the compounds include an oxide, an acetate salt, a carboxylate salt, a hydride, an alcoholate, a halide, a carbonate salt, a sulfate salt and the like of manganese, magnesium, titanium, zinc, aluminum, calcium, cobalt, sodium, lithium and lead.

Among these, compounds of manganese, magnesium, zinc, titanium, sodium and lithium are preferred from the standpoint of melt stability, hue, decrease of polymer-insoluble matters and stability upon spinning, and compounds of manganese, magnesium and zinc are more preferred. The compounds may be used in combination of two or more kinds thereof.

The polymerization catalyst is not particularly limited, and examples thereof include compounds of antimony, titanium, germanium, aluminum, zirconium and tin. Examples of the compounds include an oxide, an acetate salt, a carboxylate salt, a hydride, an alcoholate, a halide, a carbonate salt, a sulfate salt and the like of antimony, titanium, germanium, aluminum, zirconium and tin. The compounds may be used in combination of two or more kinds thereof.

Among these, an antimony compound is particularly preferred since the polyester is excellent in polymerization activity, solid state polymerization activity, melt stability and hue, and the resulting fibers have high strength and exhibit excellent spinning property and drawing property.

In the invention, the polymer is melted and discharged from a spinneret to form fibers, and it is necessary that at least one of a phosphorus compound represented by the following formula (I) or (II) is added to the polymer in a molten state, and the polymer is then discharged from the spinneret:

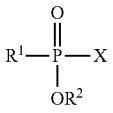

(I)

wherein $R^1$ represents an alkyl group, an aryl group or a benzyl group as a hydrocarbon group having from 1 to 20 carbon atoms; $R^2$ represents a hydrogen atom, or an alkyl group, an aryl group or a benzyl group as a hydrocarbon group having from 1 to 20 carbon atoms; and X represents a hydrogen atom or a —$OR^3$ group, wherein when X represents a —$OR^3$ group, $R^3$ represents a hydrogen atom, or an alkyl group, an aryl group or a benzyl group as a hydrocarbon group having from 1 to 12 carbon atoms, provided that $R^2$ and $R^3$ may be the same as or different from each other,

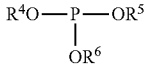

(II)

wherein $R^4$ to $R^6$ each represent an alkyl group, an aryl group or a benzyl group as a hydrocarbon group having from 4 to 18 carbon atoms, provided that $R^4$ to $R^6$ may be the same as or different from each other.

The alkyl group, the aryl group and the benzyl group used in the formulae may be substituted groups. $R^1$ and $R^2$ each are preferably a hydrocarbon group having from 1 to 12 carbon atoms.

Preferred examples of the compound of the general formula (I) include phenylphosphonic acid, monomethyl phenylphosphonate, monoethyl phenylphosphonate, monopropyl phenylphosphonate, monophenyl phenylphosphonate, monobenzyl phenylphosphonate, (2-hydroxyethyl)phenylphosphonate, 2-naphthylphosphonic acid, 1-naphtylphosphonic acid, 2-anthrylphosphonic acid, 1-anthrylphosphonic acid, 4-biphenylphosphonic acid, 4-methylphosphonic acid, 4-methoxyphosphonic acid, phenylphosphinic acid, methyl phenylphosphinate, ethyl phenylphosphinate, propyl phenylphosphinate, phenyl phenylphosphinate, benzyl phenylphosphinate, (2-hydroxyethyl)phenylphosphinate, 2-naphthylphosphinic acid, 1-naphthylphosphinic acid, 2-anthrylphosphinic acid, 1-anthrylphosphinic acid, 4-biphenylphosphinic acid, 4-methylphenylphosphinic acid, 4-methoxyphenylphosphinic acid and the like.

Examples of the compound of the general formula (II) include bis(2,4-di-tert-butylphenyl)pentaerythritol diphosphite, bis(2,6-di-tert-butyl-4-methylphenyl)pentaerythritol diphosphite, tris(2,4-di-tert-butylphenyl)phosphite and the like.

In the compound of the general formula (I), it is preferred that $R^1$ represents an aryl group, $R^2$ represents a hydrogen atom, or an alkyl group, an aryl group or a benzyl group as a hydrocarbon group, and $R^3$ represents a hydrogen atom or a —OH group.

Accordingly, particularly preferred examples of the phosphorus compound used in the invention include a compound represented by the following general formula (I'):

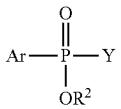

(I')

wherein Ar represents an aryl group as a hydrocarbon group having from 6 to 20 carbon atoms; $R^2$ represents a hydrogen atom, or an alkyl group, an aryl group or a benzyl group as a hydrocarbon group having from 1 to 20 carbon atoms; and Y represents a hydrogen atom or a —OH group.

The hydrocarbon group represented by $R^2$ used in the formula is preferably an alkyl group, an aryl group or a benzyl group, which may be substituted or unsubstituted. The substituent on $R^2$ is preferably one that does not disturb the steric conformation, and examples of the group include those substituted with a hydroxyl group, an ester group, an alkoxy group or the like. The aryl group represented by Ar in the formula (I') may be substituted, for example, with an alkyl group, an aryl group, a benzyl group, an alkylene group, a hydroxyl group, a halogen atom or the like.

Further preferred examples of the phosphorus compound used in the invention include a phenylphosphonic acid represented by the following general formula (III) and a derivative thereof:

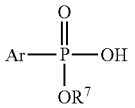

(III)

wherein Ar represents an aryl group as a hydrocarbon group having from 6 to 20 carbon atoms; and $R^7$ represents a hydrogen atom or an unsubstituted or substituted hydrocarbon group having from 1 to 20 carbon atoms.

In the invention, the particular phosphorus compound is added directly to the molten polymer, whereby the crystallinity of the polyethylene naphthalate is increased, and the polyethylene naphthalate fibers having a small crystal volume can be obtained while maintaining the high crystallinity under the subsequent production conditions. It is considered that this is because the particular phosphorus compound suppresses growth of coarse crystals formed in the spinning and drawing steps to disperse the crystals finely. It has been difficult to spin polyethylene naphthalate fibers at a high speed, but the addition of the phosphorus compound considerably improves the spinning stability and increases the practical draw ratio through prevention of a yarn break, thereby enhancing the strength of the fibers.

Examples of the hydrocarbon groups represented by $R^1$ to $R^7$ in the formulae include an alkyl group, an aryl group, a diphenyl group, a benzyl group, an alkylene group and an arylene group. These groups are preferably substituted, for example, with a hydroxyl group, an ester group or an alkoxy group.

Preferred examples of the hydrocarbon group substituted with the substituent include the following functional groups and isomers thereof:

$—(CH_2)_n—OH$ $—(CH_2)_n—OCH_3$ $—(CH_2)_n—OPh$

-Ph-OH (Ph: aromatic ring)

wherein n represents an integer of from 1 to 10.

Among these, for increasing the crystallinity, the phosphorus compound of the general formula (I) is preferred, the general formula (I') is more preferred, and the general formula (III) is particularly preferred.

For preventing scatter in vacuum during the process, with reference to the formula (I) for example, the carbon number of $R^1$ is preferably 4 or more, and more preferably 6 or more, and is particularly preferably an aryl group. In alternative, for example, the general formula (I') wherein X is a hydrogen atom or a hydroxyl group is preferred. Scatter in vacuum during the process can be suppressed in the case where X is a hydrogen atom or a hydroxyl group.

For enhancing the effect of increasing the crystallinity, $R^1$ is preferably an aryl group, and more preferably a benzyl group or a phenyl group, and in the production method of the invention, the phosphorus compound is particularly preferably phenylphosphinic acid or phenylphosphonic acid. Among these, phenylphosphonic acid and a derivative thereof are optimally used, and phenylphosphonic acid is most preferred from the standpoint of workability. Phenylphosphonic acid has a hydroxyl group and thus has a higher boiling point than an alkyl ester, such as dimethyl phosphonate, having no hydroxyl group, thereby providing an advantage that the compound is difficult to be scattered in vacuum. Accordingly, the amount of the added phosphorus compound remaining in the polyester is increased to enhance the effect per addition amount. It is also advantageous since the vacuum system is difficult to be clogged.

The addition amount of the phosphorus compound used in the invention is preferably from 0.1 to 300 mmol % based on the molar number of the dicarboxylic acid component constituting the polyester. In the case where the amount of the phosphorus compound is insufficient, there is a tendency that the effect of increasing the crystallinity is insufficient, and in the case where it is too large, there is a tendency that the yarn producing property is decreased due to occurrence of defects with foreign matters upon spinning. The content of the phosphorus compound is more preferably from 1 to 100 mmol %, and further preferably from 10 to 80 mmol %, based on the molar number of the dicarboxylic acid component constituting the polyester.

Along with the phosphorus compound, at least one metallic element selected from the group of metallic elements of the groups 3 to 12 in the fourth and fifth periods in the periodic table and Mg is preferably added to the molten polymer. In particular, the metallic element contained in the fibers is preferably at least one metallic element selected from the group of Zn, Mn, Co and Mg. While the reasons therefor are not clear, the combination use of the metallic element and the phosphorus compound facilitates provision of homogeneous crystals with less fluctuation in crystal volume. The metallic element may be added as the ester exchange catalyst or the polymerization catalyst, or may be added separately.

The content of the metallic element is preferably from 10 to 1.000 mmol % based on the ethylene naphthalate unit. The P/M ratio, which is a ratio of the phosphorus element P and the metallic element M, is preferably in a range of from 0.8 to 2.0. In the case where the P/M ratio is too small, the metal concentration becomes excessive to provide a tendency that the excessive metallic component facilitates thermal decomposition of the polymer, thereby impairing the heat stability. In the case where the P/M ratio is too large, on the other hand, the phosphorus compound becomes excessive to provide a tendency that the polymerization reaction of the polyethylene naphthalate polymer is impaired to deteriorate the properties of the fibers. The P/M ratio is more preferably from 0.9 to 1.8.

The addition timing of the phosphorus compound used in the invention is not particularly limited, and it may be added in an arbitrary step during production of the polyester. It is preferably added between the initial stage of the ester exchange reaction or the esterification reaction and the completion of polymerization. For forming further homogeneous crystals, it is more preferably added between the time when the ester exchange reaction or the esterification reaction is completed and the time when the polymerization reaction is completed.

Such a method may also be employed that the phosphorus compound is kneaded into the polyester with a kneader after polymerization. The method for kneading is not particularly limited, and an ordinary single axis or double axis kneader is preferably used. It is more preferred that a method using a vent type single axis or double axis kneader can be exemplified for controlling decrease of the polymerization degree of the resulting polyester composition.

The conditions for kneading are not particularly limited and are, for example, a temperature of the melting point of the polyester or higher and a residence time of 1 hour or less, and preferably from 1 to 30 minutes. The method for feeding the phosphorus compound and the polyester to the kneader is not particularly limited. Examples of the method include a method of feeding the phosphorus compound and the polyester separately, a method of mixing master chips containing the phosphorus compound in a high concentration with the polyester, and feeding the mixture, and the like. Upon adding the particular phosphorus compound used in the invention to the molten polymer, it is preferred that the compound is added directly to the polyester polymer without reaction with other compounds. This is because a reaction product is prevented from being formed by reacting the phosphorus compound with another compound, such as a titanium compound, in advance since it forms coarse particles, which induce structural defects and disturbance of crystals in the polyester polymer.

The polyethylene naphthalate polymer used in the invention preferably has an intrinsic viscosity in a range of from 0.65 to 1.2 as resin chips by performing known molten polymerization or solid state polymerization. In the case where the intrinsic viscosity of the resin chips is too low, it is difficult to increase the strength of the fiber after melt-spinning. In the case where the intrinsic viscosity is too high, it is not preferred from the industrial standpoint since the solid state polymerization time is largely increased to deteriorate the production efficiency. The intrinsic viscosity is more preferably in a range of from 0.7 to 1.0.

In the method for producing polyethylene naphthalate fibers of the invention, it is necessary that the polyethylene naphthalate polymer is melted and discharged from the spinneret with a spinning speed of from 4,000 to 8,000 m/min, and the molten polymer immediately after discharging from the spinneret is allowed to pass through a heated spinning chimney at a high temperature exceeding a temperature of the molten polymer by 50° C. or more, and is drawn.

The temperature of the polyethylene naphthalate polymer upon melting is preferably from 285 to 335° C., and more preferably from 290 to 330° C. The spinneret is generally one equipped with a capillary.

In the production method of the invention, the spinning speed is necessarily from 4,000 to 8,000 m/min, and preferably from 4,500 to 6,000 m/min. The ultrahigh speed spinning increases the degree of crystallization and thus achieves both high strength and high dimensional stability.

The spinning operation is preferably performed at a spinning draft of from 100 to 10,000, and preferably performed under a draft condition of from 1,000 to 5,000. The spinning draft is defined as a ratio of the spinning winding speed (spinning speed) and the spinning discharge linear velocity and is shown by the following expression (2):

$$\text{spinning draft}=\pi D^2 V/4W \quad (2)$$

wherein D represents the bore diameter of the spinneret, V represents the spinning drawing speed, and W represents the volume discharge amount per one pore.

In the production method of the invention, it is a necessary condition that the molten polymer immediately after discharging from the spinneret is allowed to pass through a heated spinning chimney at a high temperature exceeding a temperature of the molten polymer by 50° C. or more. The upper limit of the temperature of the heated spinning chimney is preferably 150° C. or less. The heated spinning chimney preferably has a length of from 250 to 500 mm. The period of time where the polymer is allowed to pass the heated spinning chimney is preferably 1.0 second or more. The use of the heated spinning chimney at a high temperature enables high-speed spinning with the crystal volume of the polyethylene naphthalate fibers maintained small. The molecules in the polymer move vigorously in the spinning chimney at a high temperature, thereby preventing large crystals from being formed.

In a conventional method for producing polyethylene naphthalate fibers, significant breakage of monofilament is liable occur when ultrahigh-speed spinning as in the invention is performed, and thus there arises a problem of lack of production stability. A polyethylene naphthalate polymer, which is a rigid polymer, is liable to be oriented immediately after discharging from a spinneret, and thus significantly suffers breakage of monofilament. However, the invention includes such characteristic features that a particular phosphorus compound is used, and delayed cooling is performed with a heated spinning chimney. According to the constitution, fine crystals of the polymer, which have not been attained conventionally, are formed, and a homogeneous structure can be obtained with the same orientation degree. Owing to the homogeneous structure, breakage of monofilament does not occur, and high spinning property can be ensured even though ultrahigh-speed spinning at from 4,000 to 8,000 m/min is performed. The polyethylene naphthalate fibers of the invention exhibit excellent fatigue resistance owing to the homogeneous polymer structure with fine crystals.

The spun yarn having been passed through the heated spinning chimney is preferably cooled by blowing cold air at 30° C. or lower. The cold air is preferably at 25° C. or lower. The blowing amount of the cold air is preferably from 2 to 10 $N^3$/min, and the blowing length thereof is preferably about from 100 to 500 mm. The cooled yarn is then preferably coated with finish oil.

The undrawn yarn thus spun preferably has a birefringence ($\Delta n_{UD}$) of from 0.25 to 0.35, and a density ($\rho_{UD}$) of from 1.345 to 1.365. In the case where the birefringence ($\Delta n_{UD}$) and the density ($\rho_{UD}$) are small, there is a tendency that the orientation crystallization of the fibers in the spinning step is insufficient, thereby failing to provide heat resistance and excellent dimensional stability. In the case where the birefringence ($\Delta n_{UD}$) and the density ($\rho_{UD}$) are excessively increased, it can be expected that there is a tendency that coarse crystals are formed in the spinning step to provide a tendency of becoming production substantially difficult. Furthermore, the subsequent drawing property is also impaired to provide a tendency that fibers with high properties are difficult to be produced. The spun undrawn yarn more preferably has a density ($\rho_{UD}$) of from 1.350 to 1.360.

In the method for producing polyethylene naphthalate fibers of the invention, thereafter, the yarn is drawn, and fibers having both a high degree of crystallization and a significantly small crystal volume can be obtained since the fibers are obtained by performing ultrahigh-speed spinning of a polymer containing fine crystals. Upon drawing, the yarn may be drawn by a so-called separate drawing method, in which the yarn is once wound from a pickup roller and then drawn, or in alternative by a so-called direct drawing method, in which the undrawn yarn is fed from a pickup roller continuously to the drawing step. The drawing condition may be one-step or multi-step drawing, and the stretching load ratio is preferably from 60 to 95%. The drawing load ratio is a ratio of the tension upon drawing to the tension, at which the fibers are actually broken. The degree of crystallization can be effectively increased by increasing the draw ratio or the drawing load ratio.

The preheating temperature upon drawing is preferably a temperature that is equal to or higher than the glass transition point of the polyethylene naphthalate undrawn yarn and is equal to or lower than a temperature lower than the crystallization starting temperature thereof by 20° C. or more, and is suitably from 120 to 160° C. in the invention. The draw ratio depends on the spinning speed and is preferably such a draw ratio that provides a drawing load ratio of from 60 to 95% based on the breaking draw ratio. For enhancing the dimensional stability while maintaining the strength of the fibers, the fibers are preferably thermally set at a temperature of from 170° C. to the melting point of the fibers or lower. The thermally setting temperature upon drawing is further preferably from 170 to 270° C.

In the production method of the invention, the use of the particular phosphorus compound enables stable ultrahigh-speed spinning in the melt spinning process of polyethylene naphthalate fibers. In the case where the particular phosphorus compound of the invention is not used, decrease of the spinning speed is the only method for stable industrial production, thereby failing to provide fibers excellent in fatigue resistance having both high dimensional stability and high strength as in the invention.

In the method for producing polyethylene naphthalate fibers of the invention, the resulting fibers may be twisted or combined to provide a desired fiber cord. The surface thereof is preferably coated with an adhesion treating agent. The adhesion treating agent is preferably an RFL adhesion treating agent for the purpose of reinforcing rubber.

More specifically, the fiber cord can be obtained in such a manner that the polyethylene naphthalate fibers are or are not twisted by an ordinary method, and are applied with an RFL treating agent and subjected to a heat treatment, and thus the fibers can be formed into a treated cord that is favorably used for reinforcing rubber.

The polyethylene naphthalate fibers for an industrial material thus obtained can be combined with a polymer to form into a fiber-polymer composite material. The polymer herein is preferably a rubber elastic material. The composite material is considerably excellent in molding property since the polyethylene naphthalate fibers of the invention used for reinforcing have high strength and are excellent in dimensional stability. In particular, the advantages of the polyethylene naphthalate fibers of the invention become significant in the case where the fibers are used for reinforcing rubber, and thus the fibers are favorably used for a tire, a belt, a hose and the like.

In the case where the polyethylene naphthalate fibers of the invention are used as a cord for reinforcing rubber, the following method, for example, may be employed. That is, the polyethylene naphthalate fibers are combined and twisted at a twisting coefficient $K=T\cdot D^{1/2}$ (wherein T represents the number of twisting per 10 cm, and D represents the fineness of the twisted cord) of from 990 to 2,500 to form a twisted cord, and the cord is subjected to an adhesive treatment and subsequently to a treatment at from 230 to 270° C.

The treated cord obtained from the polyethylene naphthalate fibers of the invention has a strength of from 100 to 200 N and a dimensional stability coefficient of 5.0% or less, which is expressed by the sum of the elongation at a stress of 2 cN/dtex (EASL (Elongation at Specific Load)) and the hot air shrinkage at 180° C., and thus such a treated cord can be obtained that has a high modulus and is excellent in heat resistance and dimensional stability. The dimensional stability coefficient herein means that a lower value thereof provides a high modulus and a low hot air shrinkage. The treated cord obtained from the polyethylene naphthalate fibers of the invention more preferably has a strength of from 120 to 170 N and a dimensional stability coefficient of from 4.0 to 5.0%.

EXAMPLE

The invention will be described in more detail with reference to examples below, but the invention is not limited thereto. The characteristic values in the examples and comparative examples were measured in the following manners.

(1) Intrinsic Viscosity IVf

A resin or fibers are dissolved in a mixed solvent of phenol and o-dichlorobenzene (volume ratio: 6/4) and measured therefor with an Ostwald viscometer at 35° C.

(2) Tenacity, Elongation and EASL (Elongation at Specific Load)

These were measured according to JIS L1013. The EASL (Elongation at Specific Load) of the fibers was obtained from the elongation at a stress of 4 cN/dtex. The EASL (Elongation at Specific Load) of the fiber cord was obtained from the elongation at a stress of 44 N.

(3) Hot Air Shrinkage

A shrinkage at 180° C. for 30 minutes was measured according to the method B (filament shrinkage rate) of JIS L1013.

(4) Specific Gravity and Degree of Crystallization

The specific gravity was measured with a carbon tetrachloride/n-heptane density gradient tube at 25° C. The degree of crystallization was obtained from the resulting specific gravity according to the following expression (1).

$$\text{degree of crystallization } Xc=\{\rho c(\rho-\rho a)/\rho(\rho c-\rho a)\}\times 100 \quad (1)$$

wherein

ρ: specific gravity of polyethylene naphthalate fibers

ρa: 1.325 (perfect amorphous density of polyethylene naphthalate fibers)

ρc: 1.407 (perfect crystal density of polyethylene naphthalate fibers)

(5) Birefringence (Δn)

It was obtained by using bromonaphtalene as an immersion liquid with a Bereck compensator according to a retardation method (see Kobunshi Jikken Kagaku Kouza, Kobunshi Bussei 11 (Course of Polymer Experimental Chemistry, Properties of Polymer 11), published by Kyoritsu Shuppan Co., Ltd.).

(6) Crystal Volume and Maximum Peak Diffraction Angle

The crystal volume and the maximum peak diffraction angle of the fibers were obtained with D8 DISCOVER with GADDS Super Speed, produced by Bruker Japan Co., Ltd. according to the wide angle X-ray diffraction method.

The crystal volume was calculated from the half value widths of the diffraction peaks with 2Θ appearing at diffraction angles of from 15 to 16°, from 23 to 25°, and from 22.5 to 27° in the wide angle X-ray diffraction spectrum of the fibers according to the Feller's equation:

$$D=\frac{0.94\times\lambda\times 180}{\pi\times(B-1)\times\cos\Theta} \quad (3)$$

wherein D represents the crystal size, B represents the half value width of the diffraction peak intensity, Θ represents the diffraction angle, and λ represents the wavelength of X-ray (0.154178 nm=1.54178 Å), and the crystal volume per one unit crystal was obtained by the following expression:

crystal volume ($nm^3$)=crystal size (2Θ=15-16°)×crystal size (2Θ=23-25°)×crystal size (2Θ=25.5-27°)

The maximum peak diffraction angle was obtained as the diffraction angle of the peak having the largest intensity in the wide angle X-ray diffraction spectrum.

(7) Melting Point Tm and Exothermic Peak Energy ΔHcd and ΔHc 10 mg of the fibers as a specimen was heated to 320° C. at a temperature increasing condition of 20° C. per minute under a nitrogen stream with a differential scanning calorimeter, Model Q10, produced by TA Instruments Co., Ltd., and the temperature of the endothermic peak appearing was designated as the melting point Tm.

Subsequently, the fiber specimen melted by retaining at 320° C. for 2 minutes was measured under a temperature decreasing condition of 10° C. per minute to measure an exothermic peak appearing, and the temperature of the apex of the exothermic peak was designated as Tcd. The energy was calculated from the peak area and was designated as ΔHcd (exothermic peak energy under a temperature decreasing condition of 10° C. per minute under a nitrogen stream).

Separately, the fiber specimen after measuring the melting point Tm was melted by retaining at 320° C. for 2 minutes, solidified by quenching in liquid nitrogen, and then measured for exothermic peak appearing under a temperature increasing condition of 20° C. per minute, and the temperature of the apex of the exothermic peak was designated as Tc. The energy was calculated from the peak area and was designated as ΔHc (exothermic peak energy under a temperature increasing condition of 20° C. per minute under a nitrogen stream).

(8) Spinning Property

The spinning property was evaluated by the following four grades from the number of occurrence of yarn breaks per 1 ton of polyethylene naphthalate in the spinning step or the drawing step.

+++: number of occurrence of yarn breaks of from 0 to 2 per 1 ton

++: number of occurrence of yarn breaks of from 3 to 5 per 1 ton

+: number of occurrence of yarn breaks of 6 or more per 1 ton

−: unable to spin (9) Production of Treated Cord

The fibers were applied with Z-twisting of 490 turns per meter, and two resulting yarn bundles were applied with S-twisting of 490 turns per meter to provide a raw cord of 1,100 dtex×2. The raw cord was immersed in an adhesive (RFL) liquid and subjected to a heat treatment under tension at 240° C. for 2 minutes.

(10) Dimensional Stability

The treated cord was measured for an EASL (Elongation at Specific Load) under a load of 44 N and a hot air shrinkage at 180° C. in the similar manner as in the items (2) and (3), and the values obtained were summed.

dimensional stability coefficient of treated cord=44 N EASL of treated cord+180° C. hot air shrinkage

(11) Tube Life Fatigue

A tube was produced with the resulting treated cord and rubber, and measured for the period of time until the tube was broken by the method according to JIS L1017, appendix 1, 2.2.1 "Tube Life Fatigue". The test angle was 85°.

(12) Disc Fatigue

A composite material was produced with the resulting treated cord and rubber, and measured by the method according to JIS L1017, appendix 1, 2.2.2 "Disc Fatigue". The measurement was performed with a stretching ratio of 5.0% and a compression ratio of 5.0%, and the strength holding ratio after continuous operation for 24 hours was obtained.

Example 1

A mixture of 100 parts by weight of dimethyl 2,6-naphthalenedicarboxylate and 50 parts by weight of ethylene glycol, 0.030 part by weight of manganese acetate tetrahydrate and 0.0056 part by weight of sodium acetate trihydrate were charged in a reactor equipped with a distillation column and a condenser for distilling methanol, and ester exchange reaction was performed while the temperature was gradually increased from 150° C. to 245° C. with methanol formed through reaction being distilled off. Before completing the ester exchange reaction, subsequently, 0.03 part by weight (50 mmol %) of phenylphosphonic acid (PPA) was added thereto. Thereafter, 0.024 part by weight of diantimony trioxide was added to the reaction product, which was transferred to a reactor equipped with an agitator, a nitrogen introducing port, a depressurizing port and a distillation device, and heated to 305° C. to perform polycondensation reaction under high vacuum of 30 Pa or less, thereby providing chips of a polyethylene naphthalate resin having an intrinsic viscosity of 0.62 according to an ordinary method. The chips were preliminarily dried under vacuum of 65 Pa at 120° C. for 2 hours and then subjected to solid state polymerization under the same vacuum condition at 240° C. for from 10 to 13 hours, thereby providing chips of a polyethylene naphthalate resin having an intrinsic viscosity of 0.74.

The chips were discharged from a spinneret having a number of pores of 249, a pore diameter of 1.2 mm and a land length of 3.5 mm at 320° C., and spun under conditions of a spinning speed of 4,500 m/min and a spinning draft of 2,160. The yarn thus spun was allowed to pass through a heated spinning chimney having a length of 350 mm and an atmospheric temperature of 400° C., which was disposed immediately beneath the spinneret, and then cooled by blowing cooling air at 25° C. at a flow rate of 6.5 $Nm^3$/min over a length of 450 mm immediately beneath the heated spinning chimney. Thereafter, the yarn was coated with finish oil that was fed in a prescribed amount with finish oil coating device, and the yarn was then introduced to a drawing roller and wound with a winder. The undrawn yarn was obtained with favorable spinning property without breakage of the yarn or monofilament, and the undrawn yarn had an intrinsic viscosity IVf of 0.70.

The undrawn yarn was then drawn in the following manner. The draw ratio was set to provide a drawing load ratio of 92% with respect to the breaking draw ratio.

Specifically, the undrawn yarn was applied to prestretching of 1%, subjected to the first step drawing between a heating and feeding roller at 150° C. rotating at a circumferential velocity of 130 m/min and a first step draw roller, then subjected to the second step drawing by allowing to pass through a non-contact setting bath (length: 70 cm) heated to 230° C. for performing constant-length thermal setting between the first step draw roller heated to 180° C. and the second step draw roller heated to 180° C., and wound with a winder, thereby providing a drawn yarn having a fineness of 1,100 dtex and a number of monofilaments of 249. The total draw ratio (TDR) was 1.50, and favorable spinning property was obtained without breakage of yarn or monofilament. The production conditions are shown in Table 1.

The resulting drawn yarn had a fineness of 1,000 dtex, a crystal volume of 128 $nm^3$ (128,000 $Å^3$) and a degree of crystallization of 50%. The drawn yarn had ΔHc and ΔHcd of J/g and 33 J/g, respectively, which indicated high crystallinity. The resulting polyethylene naphthalate fibers had a tenacity of 8.8 cN/dtex and hot air shrinkage at 180° C. of 6.8%, which indicated excellence in high strength and low contraction property.

The resulting yarn was applied with Z-twisting of 490 turns per meter, and two yarn bundles were applied with S-twisting of 490 turns per meter to provide a raw cord of 1,100 dtex×2. The raw cord was immersed in an adhesive (RFL) liquid and subjected to a heat treatment under tension at 245° C. for 2 minutes. The resulting treated cord had a strength of 154 N and a dimensional stability coefficient of 4.4%, which indicated excellent dimensional stability, and was excellent in both Tube Life Fatigue and Disc Fatigue. The properties are shown in Table 3.

Example 2

The spinning speed in Example 1 was changed from 4,500 m/min to 5,000 m/min, and the spinning draft ratio was changed from 2,160 to 2,420. The subsequent draw ratio in Example 1 was changed from 1.50 to 1.30 to provide a drawn yarn having the same fineness. Stable spinning property was obtained as similar to Example 1.

The resulting drawn yarn had a crystal volume of 152 $nm^3$ (152,000 $Å^3$) and a degree of crystallization of 49%. The resulting polyethylene naphthalate fibers had a tenacity of 8.6 cN/dtex and hot air shrinkage of 6.5% at 180° C., which indicated excellence in high strength and low contraction property.

The drawn yarn was formed into a treated cord in the same manner as in Example 1.

The production conditions are shown in Table 1, and the resulting properties are shown in Table 3.

Example 3

The spinning speed in Example 1 was changed from 4,500 m/min to 5,500 m/min, and the spinning draft ratio was changed from 2,160 to 2,700. The subsequent draw ratio in Example 1 was changed from 1.50 to 1.22 to provide a drawn yarn having the same fineness. Stable spinning property was obtained as similar to Example 1.

The resulting drawn yarn had a crystal volume of 163 $nm^3$ (163,000 $Å^3$) and a degree of crystallization of 48%. The resulting polyethylene naphthalate fibers had a tenacity of 8.5 cN/dtex and hot air shrinkage of 6.3% at 180° C., which indicated excellence in high strength and low contraction property.

The drawn yarn was formed into a treated cord in the same manner as in Example 1.

The production conditions are shown in Table 1, and the resulting properties are shown in Table 3.

Comparative Example 1

Chips of a polyethylene naphthalate resin were obtained in the same manner as in Example 3 except that 40 mmol % of orthophosphoric acid was added instead of phenylphosphonic acid (PPA), which was the phosphorus compound, before completing the ester exchange reaction in the polymerization of polyethylene 2,6-naphthalate. The resin chips were subjected to melt spinning in the same manner as in Example 3, but were not able to spin stably due to frequent occurrence of breakage of the yarn upon spinning.

In the case where the temperature of the spinning chimney was changed from 400° C. to 300° C., and the case where the length of the heated spinning chimney was changed from 350 mm to 135 mm, the spinning property was deteriorated to such an extent that fibers were not able to be collected.

Fibers and a cord were obtained with the yarn, which was collected with difficulty, in the same manner as in Example 3.

The resulting treated cord was embedded in rubber and measured for fatigue resistance, and both the Disc Fatigue and the Tube Life Fatigue were inferior to Examples. The production conditions are shown in Table 1, and the resulting properties are shown in Table 3.

Example 4

Fibers and a cord were obtained in the same manner as in Example 3 except that the phosphorus compound was changed from phenylphosphonic acid (PPA) used in Example 3 to phenylphosphinic acid (PPI), and the addition amount thereof was changed to 100 mmol %.

The resulting fibers were excellent in high strength and low contraction property. The fibers had favorable spinning property without breakage of yarn.

The production conditions are shown in Table 1, and the resulting properties are shown in Table 3.

Comparative Example 2

The spinning speed in Example 4 was changed from 5,500 m/min to 3,000 m/min, and the spinning draft ratio was changed from 2,700 to 615. The bore diameter of the spinneret was changed from 1.2 mm to 0.8 mm for conforming the fineness of the resulting fibers, and the draw ratio was changed from 1.19 to 1.93, thereby providing polyethylene naphthalate fibers.

While the spinning property involves difficulty due to increase of the draw ratio, yarn and fibers were able to be produced finally.

The resulting drawn yarn had a crystal volume of 272 $nm^3$ (272,000 $Å^3$) and a degree of crystallization of 49%. The resulting polyethylene naphthalate fibers had a tenacity of 7.3 cN/dtex, which indicated poor strength obtained even with the high draw ratio.

The drawn yarn was formed into a treated cord in the same manner as in Example 1.

The resulting treated cord was embedded in rubber and measured for fatigue resistance, and both the Disc Fatigue and the Tube Life Fatigue were inferior to Examples. The production conditions are shown in Table 2, and the resulting properties are shown in Table 4.

Comparative Example 3

The spinning speed in Example 4 was changed from 5,500 m/min to 459 m/min, and the spinning draft ratio was changed from 2,700 to 83. The bore diameter of the spinneret was changed from 1.2 mm to 0.5 mm for conforming the fineness of the resulting fibers. The length of the spinning chimney immediately beneath the spinneret was changed to 250 mm, and low-speed spinning was performed to provide an undrawn yarn. The subsequent draw ratio was changed to 6.10, thereby providing a drawn yarn.

The resulting drawn yarn had a crystal volume of 298 $nm^3$ (298,000 $Å^3$) and a degree of crystallization of 48%. The resulting polyethylene naphthalate fibers had a tenacity of 9.1 cN/dtex, but had hot air shrinkage of 7.0% at 180° C., which indicated poor contraction property.

The drawn yarn was formed into a treated cord in the same manner as in Example 1.

The resulting treated cord was embedded in rubber and measured for fatigue resistance, and both the Disc Fatigue and the Tube Life Fatigue were inferior to Examples. The production conditions are shown in Table 2, and the resulting properties are shown in Table 4.

Comparative Example 4

Chips of the same polyethylene naphthalate resin using orthophosphoric acid as in Comparative Example 1 were adjusted to have an intrinsic viscosity of 0.87 by solid state polymerization, the bore diameter of the spinneret was changed to 0.5 mm, the spinning speed was changed to 5,000 m/min, and the spinning draft ratio was changed to 330. The temperature of the heated spinning chimney immediately beneath the spinneret was changed to 390° C., and the length thereof was changed to 400 mm, thereby providing an undrawn yarn. The subsequent draw ratio was changed to 1.07 times to provide a drawn yarn. There was difficulty in spinning property since phenylphosphonic acid (PPA) as the phosphorus compound was not added, but the yarn was able to be produced.

The resulting drawn yarn had a large crystal volume of 502 $nm^3$ (502,000 $Å^3$) and a degree of crystallization of 45%. The resulting polyethylene naphthalate fibers had a tenacity of 6.7 cN/dtex, hot air shrinkage of 2.5% at 180° C. and a melting point of 287° C., i.e., the strength was slightly inferior.

The drawn yarn was formed into a treated cord in the same manner as in Example 1.

The resulting treated cord was embedded in rubber and measured for fatigue resistance, and both the Disc Fatigue and the Tube Life Fatigue were inferior to Examples. The production conditions are shown in Table 2, and the resulting properties are shown in Table 4.

Comparative Example 5

Chips of the same polyethylene naphthalate resin using orthophosphoric acid as in Comparative Example 1 were adjusted to have an intrinsic viscosity of 0.90 by solid state polymerization, the bore diameter of the spinneret was changed to 0.4 mm, the spinning speed was changed to 750 m/min, and the spinning draft ratio was changed to 60. The temperature of the spinning chimney immediately beneath the spinneret was changed to 330° C., which was close to the temperature of the molten polymer, and the length thereof was changed to 400 mm, thereby providing an undrawn yarn. The subsequent draw ratio was changed to 5.67 times to provide a drawn yarn. There was difficulty in spinning property with frequent breakage of monofilament since phenylphosphonic acid (PPA) as the phosphorus compound was not added, but the yarn was able to be produced.

The resulting drawn yarn had a large crystal volume of 442 $nm^3$ (442,000 $Å^3$) and a degree of crystallization of 48%.

The drawn yarn was formed into a treated cord in the same manner as in Example 1.

The resulting treated cord was embedded in rubber and measured for fatigue resistance, and both the Disc Fatigue and the Tube Life Fatigue were inferior to Examples. The production conditions are shown in Table 2, and the resulting properties are shown in Table 4.

Comparative Example 6

Chips of the same polyethylene naphthalate resin using orthophosphoric acid as in Comparative Example 1 were adjusted to have an intrinsic viscosity of 0.95 by solid state polymerization, the bore diameter of the spinneret was changed to 1.7 mm, the spinning speed was changed to 380 m/min, and the spinning draft ratio was changed to 550 for conforming the fineness of the resulting fibers. The temperature of the spinning chimney immediately beneath the spinneret was changed to 370° C., and the length thereof was changed to 400 mm, thereby providing an undrawn yarn. The subsequent draw ratio was changed to 6.85 times to provide a drawn yarn. There was difficulty in spinning property since phenylphosphonic acid (PPA) as the phosphorus compound was not added, whereby breakage of yarn occurred frequently upon drawing, and the resulting drawn yarn suffered frequent breakage of monofilament.

The resulting drawn yarn had a large crystal volume of 370 $nm^3$ (370,000 $Å^3$) and a degree of crystallization of 45%. The resulting polyethylene naphthalate fibers had a tenacity of 8.5 cN/dtex, hot air shrinkage of 5.6% at 180° C. and a melting point of 271° C., i.e., the heat resistance was inferior although high strength was obtained.

The drawn yarn was formed into a treated cord in the same manner as in Example 1.

The resulting treated cord was embedded in rubber and measured for fatigue resistance, and both the Disc Fatigue and the Tube Life Fatigue were inferior to Examples. The production conditions are shown in Table 2, and the resulting properties are shown in Table 4.

TABLE 1

Production Conditions (1)

| | Example 1 | Example 2 | Example 3 | Comparative Example 1 | Example 4 |
|---|---|---|---|---|---|
| Spinning conditions | | | | | |
| Additive* | PPA | PPA | PPA | orthophosphoric acid | PPI |
| Addition amount (mmol %) | 50 | ditto | ditto | 40 | 100 |
| IV | 0.74 | ditto | ditto | ditto | ditto |
| Spinneret bore diameter (mm) | 1.2 | ditto | ditto | ditto | ditto |
| Heating distance beneath spinneret (mm) | 350 | ditto | ditto | ditto | ditto |
| Heating temperature beneath spinneret (° C.) | 400 | ditto | ditto | ditto | ditto |
| Spinning speed (m/min) | 4,500 | 5,000 | 5,500 | ditto | ditto |
| Spinning draft ratio | 2,160 | 2,420 | 2,700 | ditto | ditto |
| Spinning property | +++ | +++ | +++ | + | +++ |

TABLE 1-continued

| Properties of undrawn yarn | | | | | |
|---|---|---|---|---|---|
| IV | 0.70 | 0.70 | 0.70 | 0.71 | 0.70 |
| Specific gravity | 1.352 | 1.355 | 1.358 | 1.357 | 1.358 |
| Δn | 0.256 | 0.280 | 0.290 | 0.291 | 0.288 |
| Draw ratio | 1.50 | 1.30 | 1.22 | 1.16 | 1.19 |

Production Conditions (2)

| | Comparative Example 2 | Comparative Example 3 | Comparative Example 4 | Comparative Example 5 | Comparative Example 6 |
|---|---|---|---|---|---|
| Spinning conditions | | | | | |
| Additive* | PPI | PPI | orthophosphoric acid | orthophosphoric acid | orthophosphoric acid |
| Addition amount (mmol %) | 100 | ditto | 40 | orthophosphoric acid | orthophosphoric acid |
| IV | 0.74 | ditto | 0.87 | 0.90 | 0.95 |
| Spinneret bore diameter (mm) | 0.8 | 0.5 | 0.5 | 0.4 | 1.7 |
| Heating distance beneath spinneret (mm) | 350 | 250 | 400 | ditto | ditto |
| Heating temperature beneath spinneret (° C.) | 400 | ditto | 390 | 330 | 370 |
| Spinning speed (m/min) | 3,000 | 459 | 5,000 | 750 | 380 |
| Spinning draft ratio | 615 | 83 | 330 | 60 | 550 |
| Spinning property | ++ | +++ | + | + | + |
| Properties of undrawn yarn | | | | | |
| IV | 0.70 | 0.70 | 0.76 | 0.76 | 0.73 |
| Specific gravity | 1.339 | 1.329 | 1.357 | 1.324 | 1.322 |
| Δn | 0.152 | 0.007 | 0.247 | 0.004 | 0.002 |
| Draw ratio | 1.93 | 6.10 | 1.07 | 5.67 | 6.85 |

additive*: PPA (phenylphosphonic acid), PPI (phenylphosphinic acid)

ditto: same as left column blank column: no data

TABLE 3

Properties (1)

| | Example 1 | Example 2 | Example 3 | Comparative Example 1 | Example 4 |
|---|---|---|---|---|---|
| Properties of fibers | | | | | |
| Crystal volume ($nm^3$) | 128 | 152 | 163 | 205 | 173 |
| Degree of crystallization (%) | 50 | 49 | 48 | 48 | 47 |
| Maximum peak diffraction angle (°) | 23.5 | 23.4 | 23.5 | 15.5 | 23.5 |
| Tm (° C.) | 278 | 279 | 280 | 278 | 279 |
| Tc (° C.) | 209 | 208 | 208 | 224 | 216 |
| ΔHc (J/g) | 37 | 36 | 39 | 12 | 24 |
| Tcd (° C.) | 221 | 222 | 220 | 210 | 218 |
| ΔHcd (J/g) | 33 | 33 | 35 | 15 | 25 |
| Tenacity (cN/dtex) | 8.8 | 8.6 | 8.5 | 7.6 | 8.3 |
| Elongation (%) | 7.9 | 8.2 | 8.8 | 7.5 | 8.5 |
| EASL (%) | 2.7 | 2.8 | 2.9 | 3.1 | 2.9 |
| Hot air shrinkage at 180° C. (%) | 6.8 | 6.5 | 6.3 | 6.5 | 6.6 |
| Properties of treated cord | | | | | |
| Strength (N) | 154 | 152 | 152 | 140 | 149 |
| EASL (A) (%) | 2.1 | 2.1 | 2.0 | 2.1 | 2.1 |
| Hot air shrinkage at 180° C. (B) (%) | 2.3 | 2.2 | 2.2 | 2.7 | 2.2 |
| Dimensional stability (A + B) (%) | 4.4 | 4.3 | 4.2 | 4.8 | 4.3 |
| Disc Fatigue (%) | 83 | 86 | 85 | 78 | 86 |
| Tube Life Fatigue (min) | 413 | 420 | 445 | 354 | 438 |

EASL; Elongation at Specific Load

TABLE 4

| Properties (2) | | | | | |
|---|---|---|---|---|---|
| | Comparative Example 2 | Comparative Example 3 | Comparative Example 4 | Comparative Example 5 | Comparative Example 6 |
| Properties of fibers | | | | | |
| Crystal volume ($nm^3$) | 272 | 298 | 502 | 442 | 370 |
| Degree of crystallization (%) | 49 | 48 | 45 | 48 | 45 |
| Maximum peak diffraction angle (°) | 15.5 | 15.5 | 15.6 | 15.5 | 15.5 |
| Tm (° C.) | 278 | 280 | 287 | 280 | 271 |
| Tc (° C.) | 218 | 218 | 233 | 234 | 233 |
| ΔHc (J/g) | 25 | 25 | 11 | 10 | 10 |
| Tcd (° C.) | 217 | 217 | 206 | 204 | 205 |
| ΔHcd (J/g) | 23 | 23 | 13 | 12 | 11 |
| Tenacity (cN/dtex) | 7.3 | 9.1 | 6.7 | 8.8 | 8.5 |
| Elongation (%) | 10.3 | 10.8 | 8.1 | 6.9 | 11.0 |
| EASL (%) | 3.4 | 2.7 | 3.2 | 2.5 | 4.0 |
| Hot air shrinkage at 180° C. (%) | 7.6 | 7.0 | 2.5 | 6.0 | 5.6 |
| Properties of treated cord | | | | | |
| Strength (N) | 132 | 157 | 138 | 152 | 147 |
| EASL (A) (%) | 2.2 | 2.0 | 2.1 | 2.1 | 2.1 |
| Hot air shrinkage at 180° C. (B) (%) | 3.1 | 3.2 | 2.2 | 3.5 | 3.7 |
| Dimensional stability (A + B) (%) | 5.3 | 5.2 | 4.3 | 5.6 | 5.8 |
| Disc Fatigue (%) | 76 | 80 | 75 | 70 | 72 |
| Tube Life Fatigue (min) | 315 | 295 | 303 | 225 | 247 |

EASL; Elongation at Specific Load

The invention claimed is:

1. Polyethylene naphthalate fibers comprising ethylene naphthalate as a major repeating unit, characterized in that the fibers have a crystal volume of from 100 to 200 $nm^3$ obtained by wide angle X-ray diffraction of the fiber and a degree of crystallization of from 30 to 60%.

2. The polyethylene naphthalate fibers according to claim 1, wherein the fibers have a maximum peak diffraction angle of wide angle X-ray diffraction of from 23.0 to 25.0°.

3. The polyethylene naphthalate fibers according to claim 1, wherein the fibers have an exothermic peak energy ΔHcd of from 15 to 50 J/g under a nitrogen stream and a temperature decreasing condition of 10° C. per minute.

4. The polyethylene naphthalate fibers according to claim 1, wherein the fibers contain phosphorus atoms in an amount of from 0.1 to 300 mmol % based on the ethylene naphthalate unit.

5. The polyethylene naphthalate fibers according to claim 1, wherein the fibers contain a metallic element, and the metallic element is at least one metallic element selected from the group of metallic elements of the groups 3 to 12 in the fourth and fifth periods in the periodic table and Mg.

6. The polyethylene naphthalate fibers according to claim 5, wherein the metallic element is at least one metallic element selected from the group of Zn, Mn, Co and Mg.

7. The polyethylene naphthalate fibers according to claim 1, wherein the fibers have a tenacity of from 6.0 to 11.0 cN/dtex.

8. The polyethylene naphthalate fibers according to claim 1, wherein the fibers have a melting point of from 265 to 285° C.

9. A method for producing polyethylene naphthalate fibers comprising melting a polymer having ethylene naphthalate as a major repeating unit, and discharging the polymer from a spinneret, characterized in that at least one of a phosphorus compound represented by the following formula (I) or (II) is added to the polymer in a molten state, which is then discharged from the spinneret, with a spinning speed of from 4,000 to 8,000 m/min, and the molten polymer immediately after discharging from the spinneret is allowed to pass through a heated spinning chimney at a high temperature exceeding a temperature of the molten polymer by 50° C. or more, and is drawn:

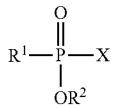

(I)

wherein $R^1$ represents an alkyl group, an aryl group or a benzyl group as a hydrocarbon group having from 1 to 20 carbon atoms; $R^2$ represents a hydrogen atom, or an alkyl group, an aryl group or a benzyl group as a hydrocarbon group having from 1 to 20 carbon atoms; and X represents a hydrogen atom or a —$OR^3$ group, wherein when X represents a —$OR^3$ group, $R^3$ represents a hydrogen atom, or an alkyl group, an aryl group or a benzyl group as a hydrocarbon group having from 1 to 12 carbon atoms, provided that $R^2$ and $R^3$ may be the same as or different from each other,

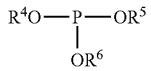

(II)

wherein $R^4$ to $R^6$ each represent an alkyl group, an aryl group or a benzyl group as a hydrocarbon group having from 4 to 18 carbon atoms, provided that $R^4$ to $R^6$ may be the same as or different from each other.

10. The method for producing polyethylene naphthalate fibers according to claim 9, wherein the spinning draft ratio after discharging from the spinneret is from 100 to 10,000.

11. The method for producing polyethylene naphthalate fibers according to claim 9, wherein the heated spinning chimney has a length of from 250 to 500 mm.

12. The method for producing polyethylene naphthalate fibers according to claim 9, wherein the phosphorus compound is a compound represented by the following general formula (I'):

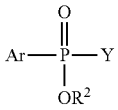

(I')

wherein Ar represents an aryl group as a hydrocarbon group having from 6 to 20 carbon atoms; $R^2$ represents a hydrogen atom, or an alkyl group, an aryl group or a benzyl group as a hydrocarbon group having from 1 to 20 carbon atoms; and Y represents a hydrogen atom or a —OH group.

13. The method for producing polyethylene naphthalate fibers according to claim 9, wherein the phosphorus compound is phenylphosphinic acid or phenylphosphonic acid.

14. The method for producing polyethylene naphthalate fibers according to claim 9, wherein the polymer in a molten state contains a metallic element, and the metallic element is at least one metallic element selected from the group of metallic elements of the groups 3 to 12 in the fourth and fifth periods in the periodic table and Mg.

15. The method for producing polyethylene naphthalate fibers according to claim 14, wherein the metallic element is at least one metallic element selected from the group of Zn, Mn, Co and Mg.

* * * * *